US009956811B2

(12) United States Patent
Mann

(10) Patent No.: US 9,956,811 B2
(45) Date of Patent: May 1, 2018

(54) MAGNETIC RULER AND CUTTING MAT

(76) Inventor: Suzanne Mann, Highland, UT (US)

( * ) Notice: Subject to any disclaimer, the term of this patent is extended or adjusted under 35 U.S.C. 154(b) by 1035 days.

(21) Appl. No.: 13/280,746

(22) Filed: Oct. 25, 2011

(65) Prior Publication Data

US 2013/0099438 A1 Apr. 25, 2013

(51) Int. Cl.

| | |
|---|---|
| ***B43L 1/00*** | (2006.01) |
| ***B43L 1/12*** | (2006.01) |
| ***B43L 3/00*** | (2006.01) |
| ***B43L 7/00*** | (2006.01) |
| ***B43L 12/02*** | (2006.01) |
| ***D05B 91/06*** | (2006.01) |

(52) U.S. Cl.

CPC ..... *B43L 1/00* (2013.01); *B43L 1/008* (2013.01); *B43L 1/12* (2013.01); *B43L 3/00* (2013.01); *B43L 7/00* (2013.01); *B43L 7/007* (2013.01); *B43L 12/02* (2013.01); *D05B 91/06* (2013.01)

(58) Field of Classification Search

CPC ..... B25B 11/002; B25B 11/007
USPC ..... 269/8, 289 R, 903, 909
See application file for complete search history.

(56) References Cited

U.S. PATENT DOCUMENTS

| | | | | |
|---|---|---|---|---|
| 6,045,319 | A * | 4/2000 | Uchida et al. | 414/676 |
| 6,361,034 | B1 * | 3/2002 | Wolfe | 269/8 |
| 2001/0042590 | A1 * | 11/2001 | Neuburger | 156/250 |
| 2011/0018182 | A1 * | 1/2011 | Day et al. | 269/8 |
| 2013/0099438 | A1 * | 4/2013 | Mann | 269/8 |

* cited by examiner

*Primary Examiner* — Lee D Wilson

(57) ABSTRACT

This document discloses magnetic sewing rulers, cutting mats, magnetic holders and magnetic ruler sewing kits are disclosed that provide tools to securely and easily hold fabrics and other sewing materials in place on a cutting mat for laying out, measuring, cutting, pinning, etc. when engaged in sewing projects. The magnetic rulers, cutting mats, and magnetic holders provide security in holding projects to allow a person to use their hands freely during sewing projects.

15 Claims, 3 Drawing Sheets

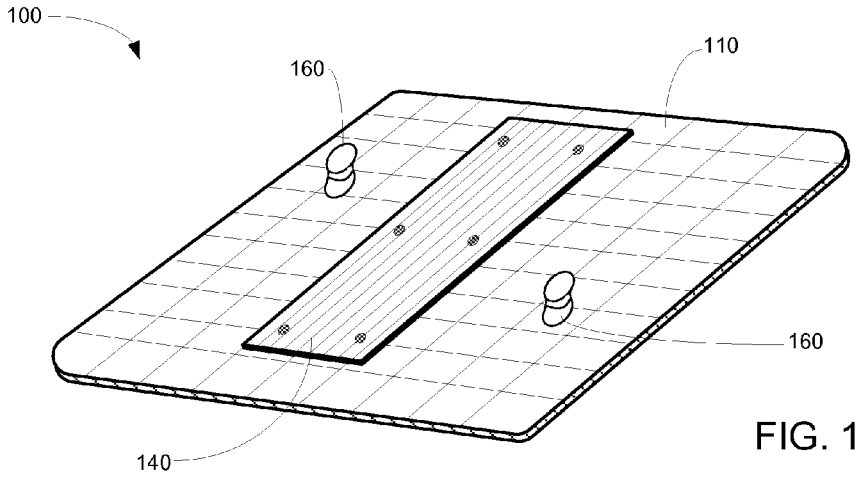
FIG. 1
FIG. 2
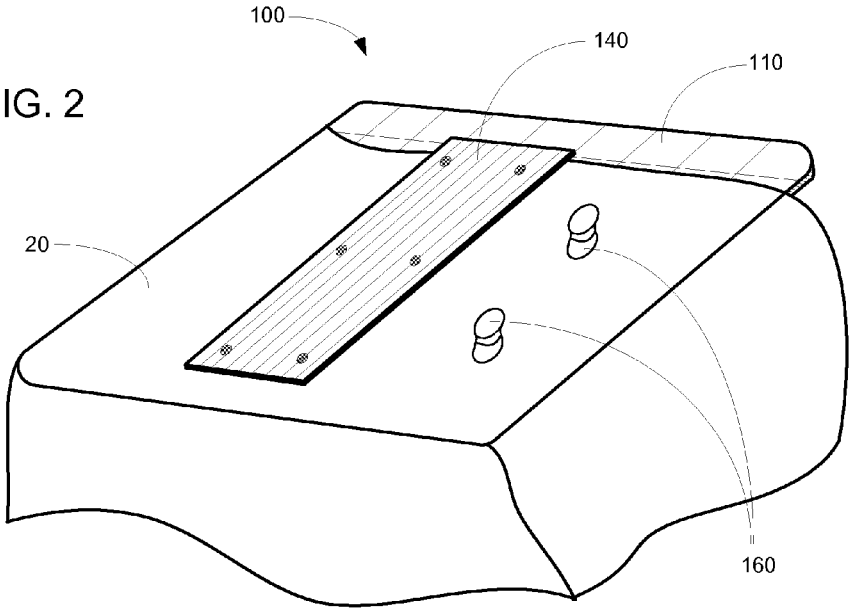

MAGNETIC RULER AND CUTTING MAT

FIELD

This application relates generally to sewing rulers, cutting mats, and methods of making and using such rulers and mats. In particular, this application relates to magnetized sewing rulers and cutting mats with a metal portion, as well as methods for making and using such sewing rulers and cutting mats.

BACKGROUND

Millions of people enjoy sewing as a hobby or profession. Many people enjoy designing clothes, quilts, and other sewing crafts that offer an outlet for creative energy. Many others enjoy spending time creating sewn items from patterns and other items. For many, sewing provides enjoyment a beauty in their lives.

Sewing clothes, quilts, crafts, etc., almost always involves the tedious task of measuring and cutting various pieces of fabric to be used in a project. Many times, these multiple pieces of fabric must be cut in various sizes and shapes as required by a sewing pattern or otherwise by a desired design. Rotary cutters and cutting mats are often used to make measuring and cutting fabric easier. However, it is still a challenge to hold the fabric during cutting to make sure the correct size, shape, and orientation of the material for each piece is achieved, as fabric has a tendency to slide and move while being cut.

Sewing rulers can be used along with sewing mats to size some pieces, provide a straight edge for cutting, and to attempt to hold the fabric still against the cutting mat or other underlying surface while cutting. Holding the ruler with pressure while making sure the fabric doesn't move and working the cutter can be difficult, particularly when the cuts require trading hands or turning around the table. Also, if pressure is removed from the sewing ruler, the fabric can slip, bunch, or otherwise move out of position, requiring the sewer to reposition the piece of fabric.

Some magnetic rulers and cutting mats have been created for use with paper cutting and scrapbooking, such as one found at: http://www.weronthenet.com/magnetic_mat_tutorial. However, such rulers and mats are not suitable for use in sewing because the magnetic material used in the ruler and mat are relatively weak magnets and are not strong enough to hold multiple layers of fabric in place. Additionally, rulers used in scrapbooking are narrow and made from metal. Metal rulers are not transparent and are unsuitable for use with fabrics where the ability to see through the ruler for precision placement of marks and seams is critical.

Tools and methods that make sewing and other crafts easier, more productive, and fun are desirable.

SUMMARY

This document discloses magnetic sewing rulers, cutting mats, magnetic holders and magnetic ruler sewing kits are disclosed that provide tools to securely and easily hold fabrics and other sewing materials in place on a cutting mat for laying out, measuring, cutting, pinning, etc. when engaged in sewing projects. The magnetic rulers, cutting mats, and magnetic holders provide security in holding projects to allow a person to use their hands freely during sewing projects. The magnetic rulers, cutting mats and magnetic holders may be stored vertically and may be used for other purposes while stored, such as a message or drawing board.

Exemplary magnetic sewing kits may include a cutting mat and a magnetic ruler. The cutting mat may have a ferromagnetic layer and a cutting layer. The magnetic ruler may have a planar body and a plurality of ruler magnets coupled to the planar body, the plurality of ruler magnets being configured to magnetically attach the magnetic ruler to the cutting mat. The magnetic sewing kit may also include at least one magnetic holder with a top portion and a holder magnet coupled to the top portion. The magnetic holder may be configured to magnetically attach to the cutting mat. The various magnets may be neodymium magnets, other rare-earth magnets, or other strong magnets.

The plurality of ruler magnets may be generally flush with a bottom surface of the planar body of the magnetic ruler. The magnetic ruler may also include at least one lifter on a top surface of the magnetic ruler, the lifter being configured to facilitate moving the magnetic ruler with respect to the cutting mat. In some embodiments, the magnetic ruler may include ruled lines on or in the planar body. Similarly, the planar body of the magnetic ruler may be translucent, and formed from one of glycol-modified polyethylene terephthalate (PETG), poly(methyl methacrylate) (PMMA), or polycarbonate.

In some embodiments, the cutting mat may include a first layer formed of a material attracted to magnets, such as a ferromagnetic material. The cutting layer may be may be bonded to the ferromagnetic layer. The cutting layer may be formed from a material that permits being repeatedly cut with a cutting instrument. The cutting mat may also include a utility layer bonded to the ferromagnetic layer, wherein ferromagnetic layer is between the cutting layer and the utility layer. The cutting mat may be configured to be hanged on a vertical surface, with the magnetic ruler magnetically attached to the hanging cutting mat for storage.

In some embodiments, the utility layer is a dry-erase board material, a cork board material, or other utility material. In other embodiments, the utility layer and the cutting layer may be formed from PVC. In some embodiments, the ferromagnetic material may be an iron steel alloy.

The cutting mat may also include grid lines visible on or through the cutting layer.

BRIEF DESCRIPTION OF THE DRAWINGS

The following description can be better understood in light of Figures, in which:

FIG. 1 illustrates an exemplary sewing mat, magnetic ruler, and holders for crafts such as sewing;

FIG. 2 illustrates an exemplary sewing mat, magnetic ruler, and holders being used with fabric for crafts such as sewing;

Figure 3:
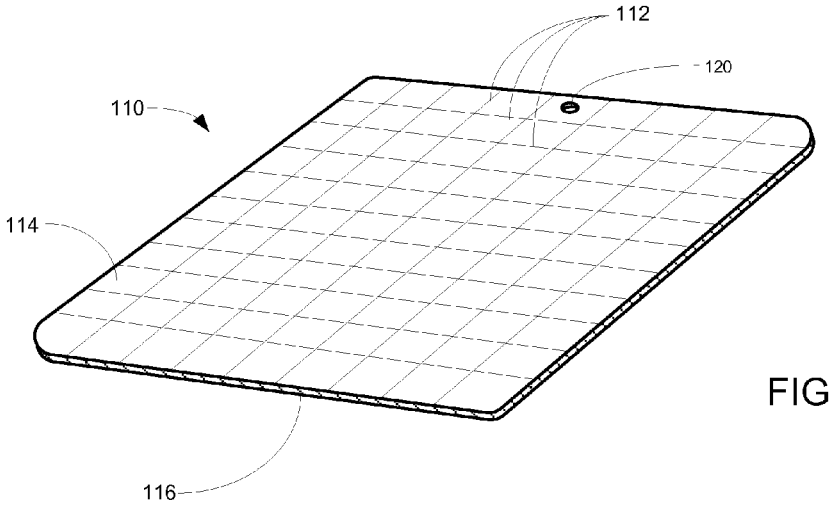
FIG. 3 illustrates a perspective view of an exemplary cutting mat for use with a magnetic ruler.

Together with the following description, the Figures demonstrate and explain the principles of the apparatus and methods for using the exemplary magnetic rulers, cutting mats, and holders described herein. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on clear rulers for use in sewing with imbedded neodymium magnets and cutting mats with a steel layer, the apparatus and associated methods could be equally applied and adapted with other functional materials, such as samarium-cobalt, other rare-earth magnets, or other strong magnets.

Embodiments of magnetic rulers, cutting mats, and holders taught herein may have any configuration consistent with the functionality as described below. One exemplary embodiment of magnetic cutting set 100 is illustrated in FIGS. 1 and 2. Magnetic cutting set 100 may include cutting mat 110, magnetic ruler 140, and holders 160. As shown in FIG. 2, fabric 20 may be placed over cutting mat 110. Fabric 20 may be any number of layers of fabric and other sewing related materials such as elastic, borders, zippers, etc. As described in further detail below, cutting mat 110 may include a metal or ferromagnetic layer, which attracts magnetic ruler 140. When fabric 20 is between cutting mat 110 and magnetic ruler 140, fabric 20 is held in place by the force created by the magnetic attraction of magnetic ruler 140 and cutting mat 110. Similarly, holders 160 may include magnets and may thereby also be attracted to cutting mat 110, and may also be used to hold fabric 20 in a desired place on cutting mat 110.

Additionally, since magnetic ruler 140 and holders are held in place by magnetic force, they may be moved and positioned as desired, allowing an individual to place fabric 20 for cutting or marking and then moving magnetic ruler 140 and/or holders 160 to position for a subsequent cut or mark. With fabric 20 held in place by magnetic ruler 140 and/or holders 160, the individual is able to use both hands for other tasks, rather than having to keep at least one hand on the ruler to make sure the desired alignment is not disrupted.

One or more holders 160 may also be used to hold fabric 20 in place while magnetic ruler 140 is repositioned, allowing an individual to quickly and accurately reposition magnetic ruler 140 without having to move, adjust, or reposition fabric 20. For example, magnetic holders may be used to hold zippers or trim in place for pinning while magnetic ruler 140 is used to ensure that the edges of the zippers or trim are properly aligned for pinning and then sewing. Of course, magnetic cutting set 100 may be used in a variety of ways where holding different pieces in precise locations while allowing an individual to use both hands for tasks.

Figure 4A:
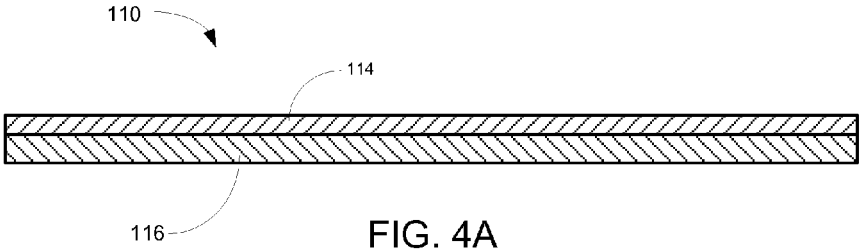
FIGS. 4A and 4B illustrate side views of exemplary cutting mats for use with a magnetic ruler.
Figure 4B:
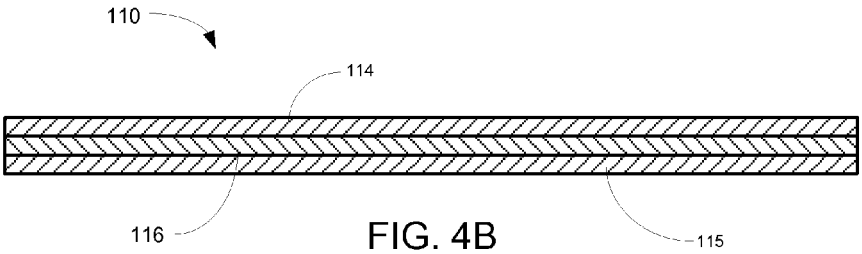

FIGS. 3-4B illustrate exemplary embodiments of cutting mat 110. As best shown in FIG. 4A, cutting mat 110 may include at least two layers, cutting layer 114 and ferromagnetic layer 116. Cutting mat 110 may be any suitable size and shape, depending on the desired application. In some embodiments, cutting mat 110 may be about 20" by 24" by 0.25", which is a suitable size for use with fat quarters (about 18" by 21") of fabric.

In other embodiments, different dimensions of cutting mat 110 may be up to 72" or more, as desired for different sewing projects. For example, a large or small sewing table may be formed using cutting mat 110 as the table top, formed as described in more detail below, with a relatively thick ferromagnetic layer 116 for structural stability and cutting layer 114. In other embodiments, a sewing table with cutting mat 110 serving as the table top, may be stored vertically against or hung on a wall (as described in more detail below) and serving as a drawing board, message board, etc. when not in use as a sewing table surface.

As shown in FIG. 3, cutting layer 114 may include grid lines 112 or other markings useful in laying out and cutting fabric. Grid lines 112 may be provided in any orientation, thickness, scale, frequency, design, pattern, etc., to provide useful reference to an individual using cutting mat 110. For example, grid lines 112 may be placed ¼" apart, with heavier lines representing gridlines 112 at each inch. Additionally, angled grid lines 112 may be included at various angles to provide reference for various designs requiring certain angles, or may include circles of various diameters, or other shapes and designs, as desired.

Grid lines 112 may be formed into, printed on, or otherwise placed on or in cutting layer 114. For example, grid lines 112 may be simply printed onto cutting layer 114, or may be imbedded into cutting layer 114 with a dye or a heat treatment. Or, in some embodiments, cutting layer 114 may be sufficiently transparent such that grid lines 112 may be printed on ferromagnetic layer 116, or on the surface of cutting layer 114 contacting ferromagnetic layer 116 prior to bonding ferromagnetic layer 116 and cutting layer 114.

As shown in FIG. 4B, cutting mat 110 may include more layers than ferromagnetic layer 116 and cutting layer 114. Ferromagnetic layer 116 may be an internal layer between cutting layer 114 and under layer 115, which may be another cutting layer, a layer suitable for use with dry-erase markers, protective layer, or other layer suitable for any other desired purpose. Cutting layer 114 and under layer 115 opposite ferromagnetic layer 116 may be formed of the same or different materials from each other. For example, on one side of cutting mat 110 may be cutting layer 114 formed of PVC, and on the opposite side may be under layer 115 formed from material suitable for use as a dry-erase board, or may be a cork layer suitable as a cutting layer or as a bulletin board, or other useful layers.

Multiple layers may be advantageous to provide additional uses for cutting mat 110. For example, cutting mat 110 may be hung on a wall through hole 120 in cutting mat 110 when not being used as a cutting mat to save space, or to provide additional utility. Cutting mat 110 may be hung on a vertical surface through hole 120, other attachment points on cutting mat 110, or any other suitable hanging device or mechanism. While hung up, such as on a wall, cutting mat 110 may be easily stored, or may be used as a useful message board, bulletin board, or other use. Because ferromagnetic layer 116 is present in cutting mat 110, under layer 115 or cutting layer 114 may be used with magnets, such as holder 160, to hold pictures, messages, etc. when cutting mat 110 is hung up. For example, cutting mat 110 may be hung on a wall with a dry-erase under layer 115 being presented outwardly. As such, under layer 115 may serve as a message or drawing board, with the ability to post pictures, notes, articles, fabric, etc. with holders 160.

Cutting layer 114 may be formed from any material suitable as a cutting surface, such as cork, wood, plastic, rubber, metal, etc. Cutting layer 114 may be formed from PVC, or similar materials, such as is commonly used in so-called "self-healing" cutting mats. Cutting layer 114 may be preferably formed of a material that extends the life of a cutting instrument by not dulling the cutting edge of a cutting instrument. Cutting layer 114 may be of sufficient thickness to resist cutting completely through cutting layer 114 when used with normal cutters, such as rotary cutters, razor knives, and using normal cutting pressure sufficient to comfortably cut all desired layers of fabric.

The layers of cutting mat 110 may be bonded together in any suitable manner. For example, cutting layer 114 and ferromagnetic layer 116 may be bonded by adhesives, heat treatment, fasteners, or by any other suitable bonding process or device. Similarly, cutting layer 114 may be formed of plastic and melted onto ferromagnetic layer 116 while forming cutting mat 110. Or, ferromagnetic layer may be imbedded in plastic during the formation process, forming cutting layer 114, outer layer 115, and ferromagnetic layer 116 between cutting layer 114 and outer layer 115.

Ferromagnetic layer 116 may be formed of any material that permits attraction by a magnet, such as ferrous metals (such as most steel, iron, and various other nickel and cobalt alloys) or any sheet magnet material. Ferromagnetic layer 116 need not be magnetic by itself, but rather be attracted to magnets. Ferromagnetic layer 116 may have any thickness suitable for strong attraction to magnetic ruler 140 and/or holders 160. Ferromagnetic layer 116 may also be sufficiently rigid to provide structural strength to cutting mat 110, to allow for softer material to be used as cutting layer 114, thereby extending the life of cutting instruments used with cutting mat 110.

Figure 5:
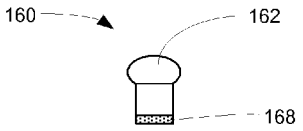
FIG. 5 illustrates an exemplary magnetic holder.

As shown in FIG. 5, holders 160 may include top 162 and magnet base 168. Top 162 may be any size, shape, or design suitable for attachment to magnet base 168 and for use as a magnetic holder to hold fabric 20, or other materials, to cutting mat 110. For example, while top 162 of FIG. 5 resembles a knob, top 162 may be or may resemble a spool, pin cushion, sculpted character, plush toy, etc. In some embodiments, pin cushions may include magnet base 168 and may be used to hold pins and concurrently be used as holder 160 while cutting and pinning fabric for sewing.

Magnet base 168 may be formed of a neodymium magnet, or other suitable magnet, of sufficient holding strength to securely hold desired layers of fabric against cutting mat 110. For example, magnet base 168 may be a 0.5" diameter by 0.13" disk magnet formed from neodymium with a pull force of about 6 lbs. or more. The magnetic strength of magnet base 168 may be selected depending on the desired use. For example, holding multiple layers of denim securely may require a larger magnet base 168. As such, an individual using cutting set 100 may have holders 160 of various strengths for different projects.

Figure 6:
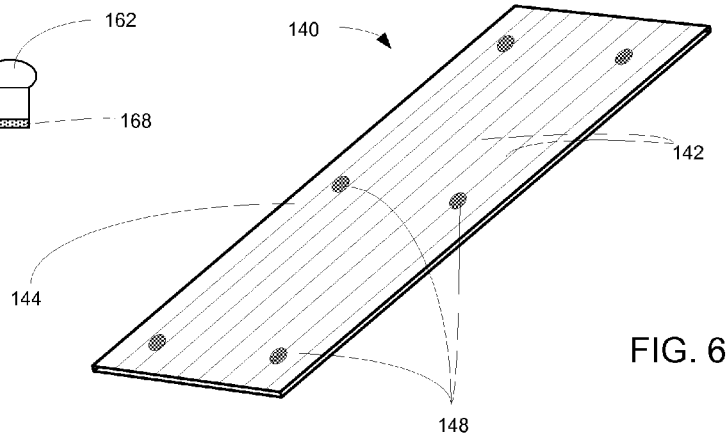
FIG. 6 illustrates a perspective view of an exemplary magnetic ruler.
Figure 7:
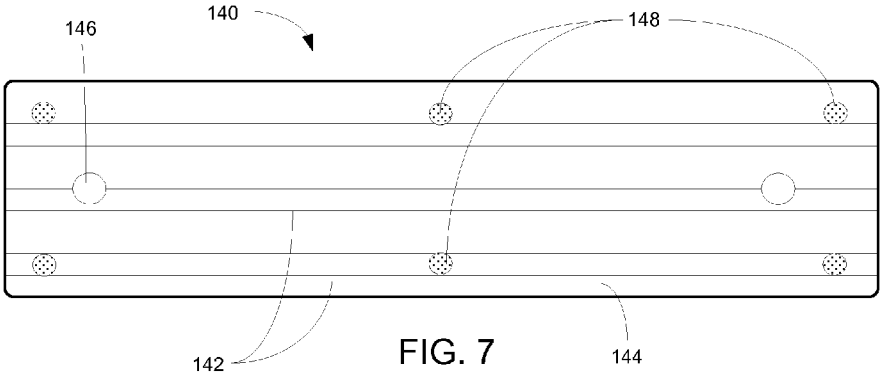
FIG. 7 illustrates a top view of an exemplary magnetic ruler.
Figure 8:
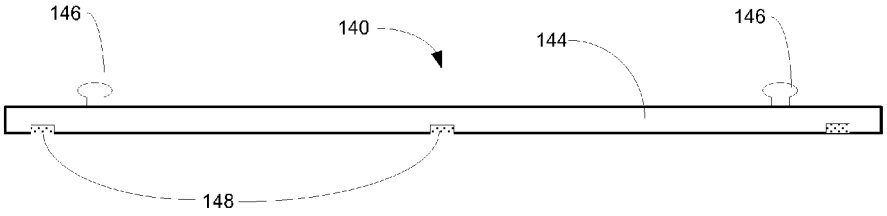
FIG. 8 illustrate a side view of an exemplary magnetic ruler.

As shown in FIGS. 6-8, magnetic ruler 140 may include base 144 and ruler magnets 148. Base 144 may include ruler lines 142 or other markings useful in laying out and cutting fabric. Lifters 146 may also be included to aid in positioning and moving magnetic ruler 140 when attached to cutting mat 110 with magnetic force.

Ruler lines 142 may be provided in any orientation, thickness, scale, frequency, design, pattern, etc., to provide useful reference to an individual using magnetic ruler 140 and cutting mat 110. For example, ruler lines 142 may be placed ¼" apart, or any other ruled distance. Additionally, other ruler lines may be included at various angles to provide reference for various designs requiring certain angles, or may include other shapes and designs, as desired.

Base 144 of magnetic ruler 140 may be formed of any material suitable for use as a sewing ruler. In some embodiments, base 144 may be formed of translucent, transparent or semi-transparent glycol-modified polyethylene terephthalate (PETG) acrylic plastic. In other embodiments, other transparent or semi-transparent materials such as poly(methyl methacrylate) (PMMA), polycarbonate, other plastics, glass, or other suitable materials may be used.

Base 144 may be any suitable size for use with various sizes of cutting mat 110. For example, for cutting mat 110 with dimensions of 20' by 24", base 144 may be 24" by 5", or other similar size. Base 144 may have sufficient thickness to give structural strength to magnetic ruler 140. Base 144 may be rectangular in shape, as illustrated, or may be other suitable shapes and sizes, such as circles, triangles, etc., and may have marking or cutting slots and holes (not shown) formed in base 144.

Base 144 may include recesses formed for placement of ruler magnets 148. Two or more ruler magnets 148 may be attached to base 144. In the illustrated embodiments, six ruler magnets 148 are shown. Ruler magnets 148 may be attached to base 144 using adhesive, press-fit, fasteners, a second magnet on or in the top surface of base 144, or by any other suitable method or device. Magnet ruler 140 may include as many magnets as is necessary to effect a secure placement of fabric between magnet ruler 140 and cutting mat 110.

Ruler magnets 148 may be formed of a neodymium magnet, or other suitable magnet of sufficient holding strength to securely hold desired layers of fabric against cutting mat 110. For example, ruler magnets 148 may be a 0.5" diameter by 0.13" disk magnet formed from neodymium with a pull force of about 6 lbs. or more. The magnetic strength of ruler magnets 148 may be selected depending on the desired use. For example, holding multiple layers of denim securely may require larger, stronger, or more ruler magnets 148. As such, magnetic ruler 140 may allow for ruler magnets 148 to be selectively removable to add, remove, or exchange magnets as needed.

As shown in FIGS. 7-8, lifters 146 may be provided with magnetic ruler 140 to facilitate repositioning or moving magnetic ruler 140 when used with cutting mat 110. In such embodiments where the force between ruler magnets 148 and cutting mat 110 is significant, lifers 146 may be useful in providing easy movement and removal of magnetic ruler relative to cutting mat 110. Lifters 146 may be any suitable shape or size and may be permanently attached or selectively removable from base 144, as desired.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

The invention claimed is:

1. A sewing ruler kit, comprising:

a cutting mat, the cutting mat including a ferromagnetic layer, and a cutting layer; and a magnetic ruler, the magnetic ruler including, a planar body, and a plurality of ruler magnets coupled to the planar body, the plurality of ruler magnets being configured to magnetically attach the magnetic ruler to the cutting mat.

2. The sewing ruler kit of claim 1, further comprising, at least one magnetic holder, including, a top portion, and a holder magnet coupled to the top portion, wherein the magnetic holder is configured to magnetically attach to the cutting mat.

3. The sewing kit of claim 2, wherein the plurality of ruler magnets are generally flush with a bottom surface of the planar body of the magnetic ruler.

4. The sewing kit of claim 2, wherein the magnetic ruler also includes at least one lifter on a top surface of the magnetic ruler, the lifter being configured to facilitate moving the magnetic ruler with respect to the cutting mat.

5. The sewing kit of claim 2, wherein, the cutting layer is bonded to the ferromagnetic layer, and wherein the cutting mat also includes, a utility layer bonded to the ferromagnetic layer, wherein ferromagnetic layer is between the cutting layer and the utility layer.

6. The sewing kit of claim 5, wherein the cutting mat is configured to be hanged on a vertical surface, and wherein the magnetic ruler is configured to be magnetically attached to the hanging cutting mat for storage.

7. The sewing kit of claim 1, wherein the planar body is formed from one of glycol-modified polyethylene terephthalate (PETE), poly(methyl methacrylate) (PMMA), or polycarbonate.

8. The sewing kit of claim 1, wherein the plurality of ruler magnets are neodymium magnets.

9. The sewing kit of claim 1, wherein the planar body is translucent.

10. The sewing kit of claim 1, wherein the ferromagnetic layer is formed from an iron steel alloy.

11. The sewing kit of claim 1, further comprising grid lines visible on or through the cutting layer.

12. The sewing kit of claim 5, wherein the utility layer is a dry-erase board material.

13. The sewing kit of claim 5, wherein the utility layer is a cork board material.

14. The sewing kit of claim 5, wherein the utility layer and the cutting layer are formed from PVC.

15. The sewing kit of claim 6, further comprising a hanging bracket to facilitate the hanging vertically.

* * * * *